US005142995A

United States Patent [19]

Brunner et al.

[11] Patent Number: 5,142,995

[45] Date of Patent: Sep. 1, 1992

[54] DRESSING KIT

[75] Inventors: Merlin A. Brunner, Appleton; Harvey J. Draheim, Weyauwega, both of Wis.

[73] Assignee: Simmons Juvenile Products Company, Inc., New London, Wis.

[21] Appl. No.: 683,072

[22] Filed: Apr. 10, 1991

Related U.S. Application Data

[63] Continuation of Ser. No. 463,398, Jan. 11, 1990, abandoned.

[51] Int. Cl.[5] ..... A47B 57/00

[52] U.S. Cl. ..... 108/63; 312/279; 312/315; 108/65

[58] Field of Search ..... 312/278, 279, 282, 313, 312/315, 316, 317.3; 108/65, 63, 94, 99, 69

[56] References Cited

U.S. PATENT DOCUMENTS

| | | | |
|---|---|---|---|
| 414,404 | 11/1889 | Grogg | 312/315 |
| 1,949,508 | 3/1934 | Woodall | 312/316 |
| 3,254,931 | 6/1966 | Jacobi | 312/315 |
| 3,703,324 | 11/1972 | Smith | 312/279 |

*Primary Examiner*—Gerald A. Anderson
*Attorney, Agent, or Firm*—Hoffmann & Baron

[57] ABSTRACT

A dressing kit is provided for dressing infants. The kit includes a base and a cover which is pivotably mounted to the base. The base includes a pair of opposing side walls and a shelf extending therebetween. The cover is pivotable between a first rotational positions where it adjoins the shelf and a second rotational position where it is maintained substantially parallel to the shelf. The shelf is positioned between the top and bottom edges of the side walls of the base.

9 Claims, 4 Drawing Sheets

DRESSING KIT

This is a continuation of copending application Ser. No. 07/463,398 filed on Jan. 11, 1990, now abandoned.

BACKGROUND OF THE INVENTION

1. Field of the Invention

The field of the invention relates to dressing kits used for changing infants' clothing and for storage purposes.

2. Brief Description of the Prior Art

Dressing kits are specialized articles of furniture which are used for retaining an infant. They facilitate dressing an infant, and also provide a measure of safety in that it is difficult for an infant to move outside the retaining walls of such kits.

One type of dressing kit which is well known to the art is a free-standing unit which is typically placed upon a dresser or other piece of furniture. The kit includes a base comprising a bottom wall, a rear wall extending upwardly from the bottom wall, and a pair of opposing side walls extending upwardly from the bottom wall. Each of the side walls includes an inclined front edge. A cover/tray assembly is pivotably mounted to the base. This assembly includes a bottom wall, an end wall, and a pair of opposing side walls. Each of the side walls includes an inclined edge which adjoins one of the inclined edges of the base when the cover/tray assembly is used as a tray. The inclined edges define a pair of continuous front edges when the cover/tray assembly is used as a cover.

A second type of dressing kit has been employed which is very similar in structure and function to the above-described kit. Such a kit is disclosed in U.S. Pat. No. 3,703,324. The primary difference between the patented assembly and free-standing units is the incorporation of the cover/tray assembly in the former as an integral part of a dresser.

SUMMARY OF THE INVENTION

It is an object of the invention to provide a dressing kit which facilitates dressing an infant.

It is another object to provide a dressing kit which includes a base and cover, the cover being pivotable about the base.

In accordance with these and other objects of the invention, a dressing kit is provided which includes a base, the base including a pair of opposing side walls, each of the side walls including a front edge, and a shelf connecting the side walls; and a cover pivotably mounted to the base, the cover including a pair of opposing side walls and a shelf connecting the side walls, the shelf of the cover being wider than the shelf of the base such that it engages the front edges of the side walls of the base when in a first rotational position with respect to the base.

The dressing kit is preferably constructed so that the shelf of the cover is inclined upwardly with respect to the shelf of the base when the cover is in the first rotational position. This feature helps contain an infant positioned within the kit.

DETAILED DESCRIPTION OF THE INVENTION

Figures 1, 2, 3:
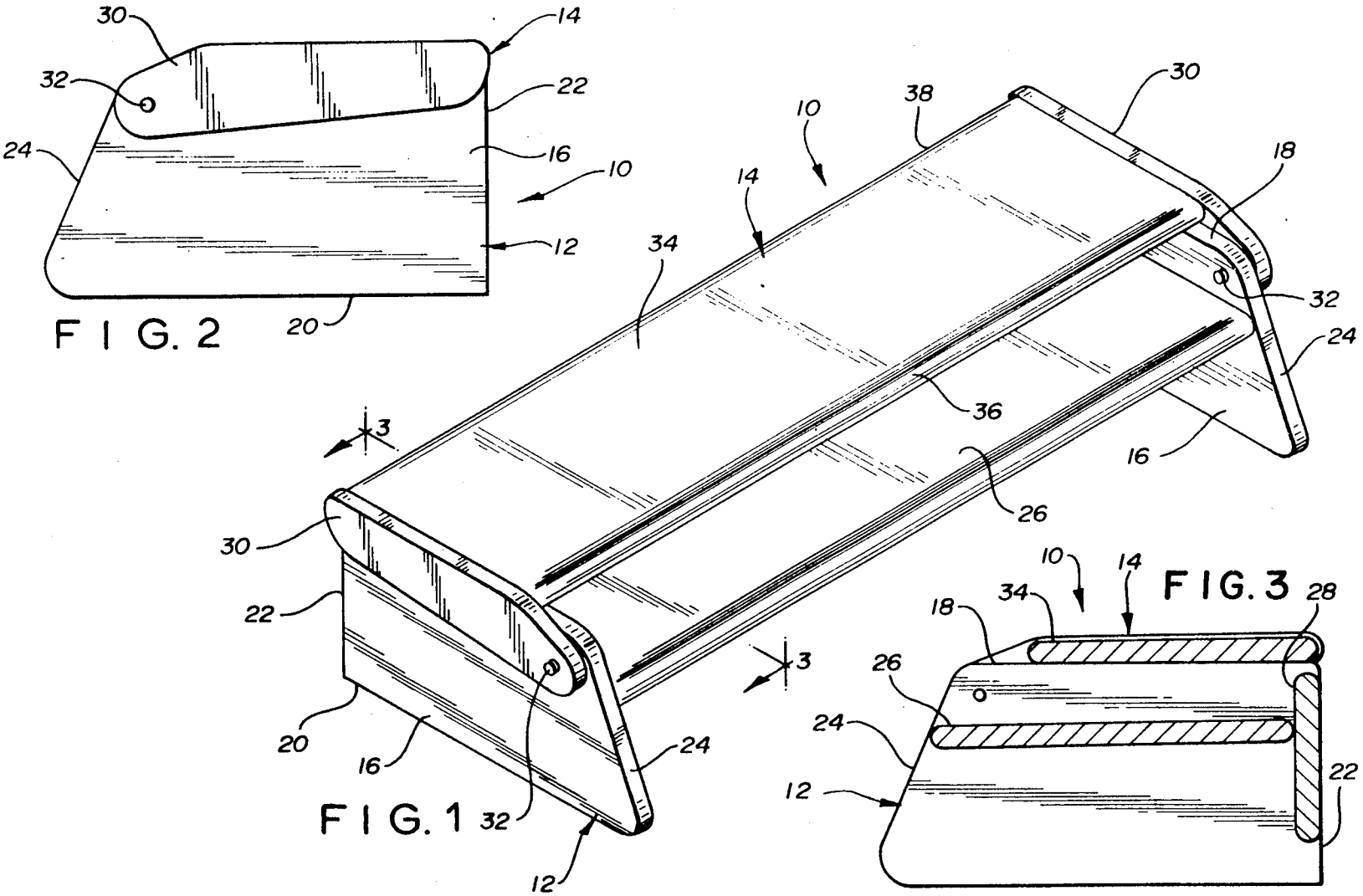
FIG. 1 is a front perspective view of a dressing kit according the invention in a closed position.
FIG. 2 is a side elevation view thereof.
FIG. 3 is a sectional view taken along line 3—3 of FIG. 1.
Figure 4:
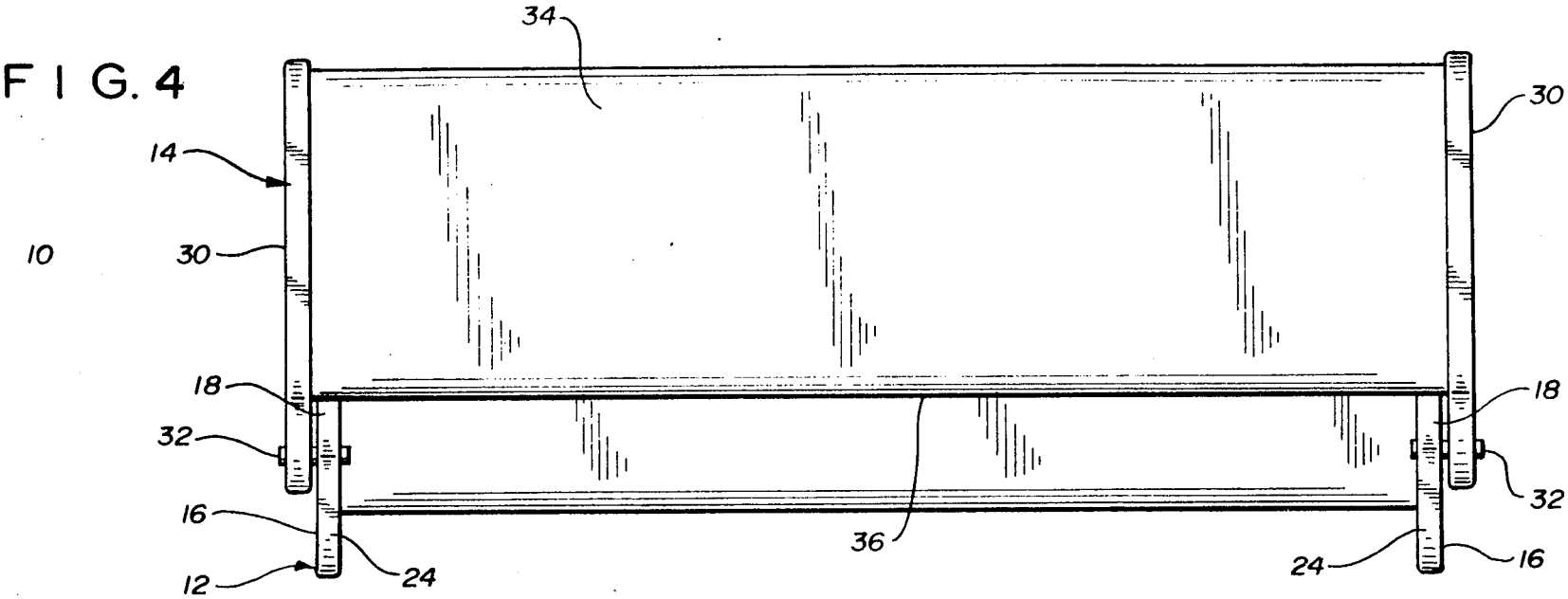
FIG. 4 is a top plan view thereof.

A dressing kit 10 is provided which includes a base and a cover 14 pivotably mounted to the base. The kit can be used for storing items and for dressing an infant.

Referring to FIGS. 1-7, the base 12 includes first and second opposing side walls 16. The side walls are substantially parallel to each other and are substantially identical in construction. Each side wall includes a top edge 18, a bottom edge 20 running substantially parallel to the top edge, a rear edge 22 which extends perpendicularly with respect to the top and bottom edges, and a front edge 24. The front edge extends at an oblique angle with respect to the horizontal plane, and connects the top and bottom edges of the side wall 16.

A shelf 26 is secured to the side walls, and connects them as shown in FIG. 1. The shelf 26 adjoins the front edge 24 of each side wall, and extends substantially parallel to and between the top and bottom edges 18, 20 thereof. The shelf is closer to the top edges than the bottom edges.

Figure 5:
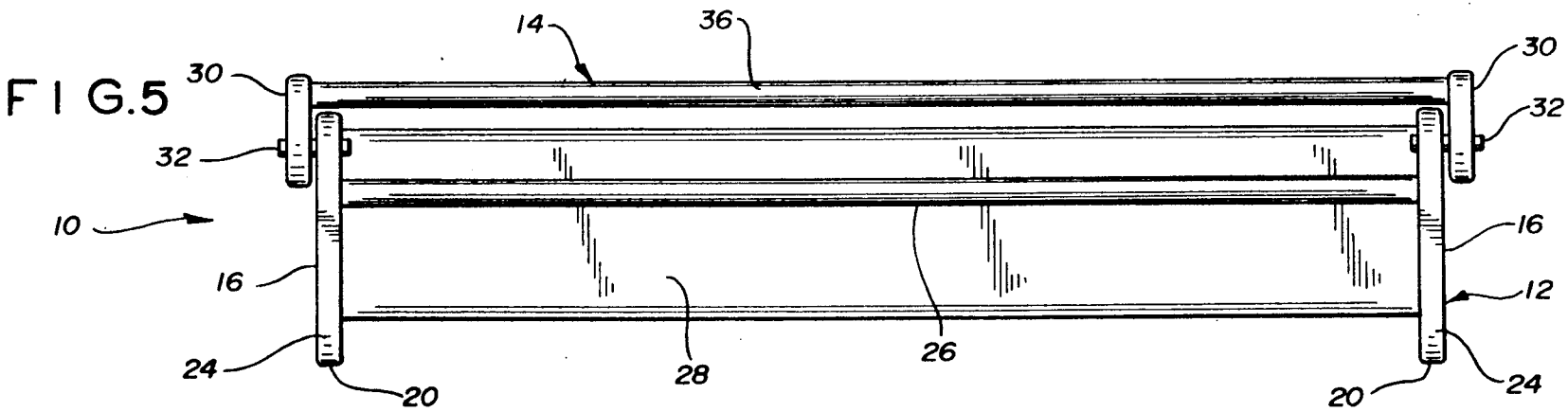
FIG. 5 is a front elevation view thereof.
Figure 6:
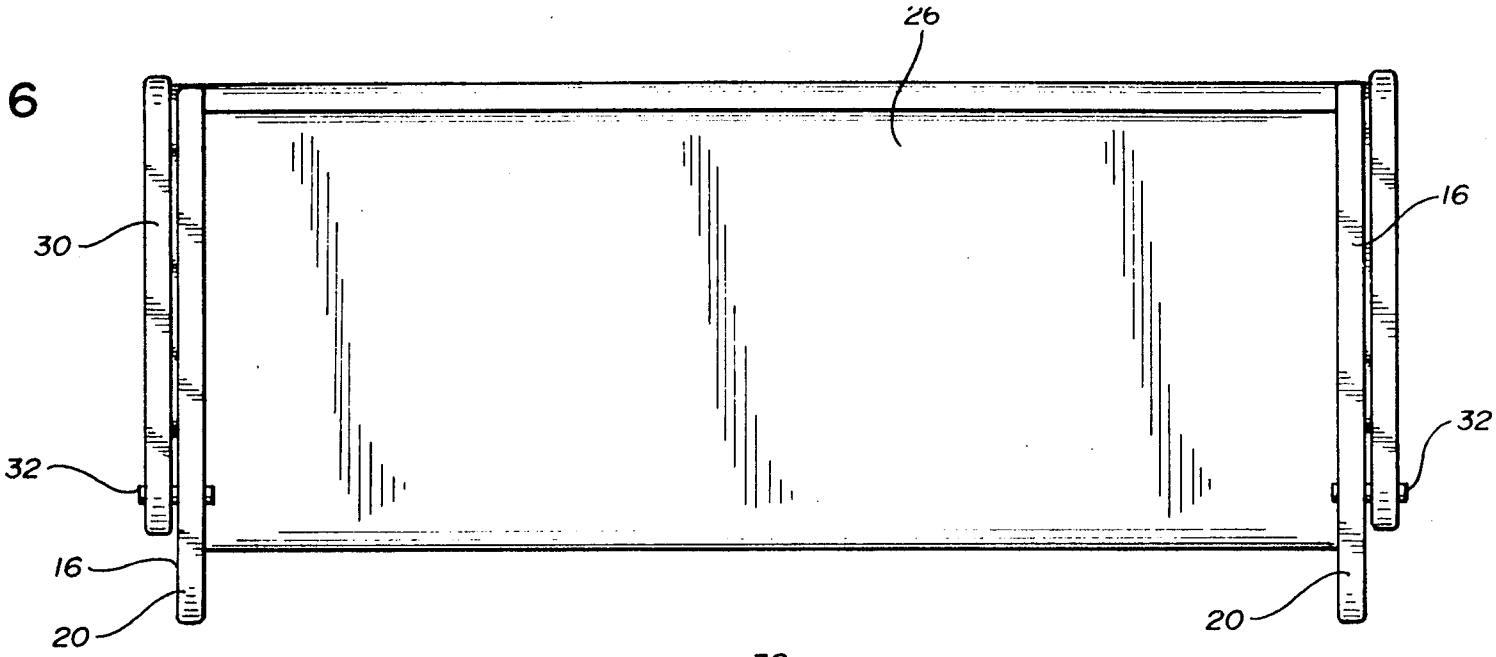
FIG. 6 is a bottom plan view thereof.
Figure 7:
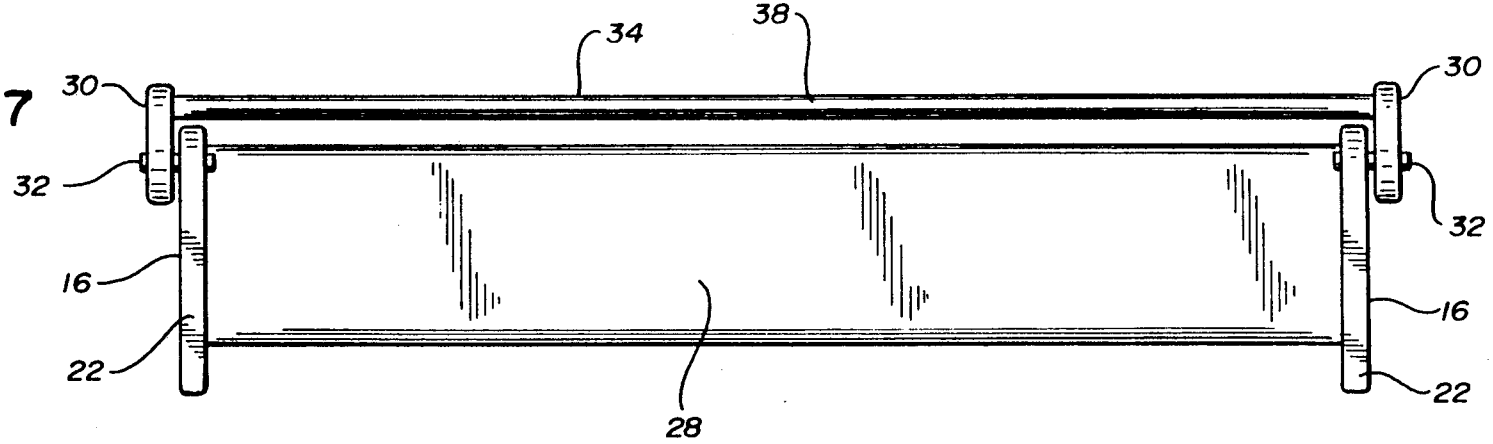
FIG. 7 is a rear elevation view thereof.

A rear wall 28 is also secured to the respective side walls 16. The rear wall adjoins the respective rear edges 22 of the side walls and the rear end of the shelf 26. It is substantially perpendicular to the shelf and side walls, and shorter in height than the side walls. The rear wall 28 accordingly adjoins neither the top nor the bottom edges of the respective side walls 16, as shown in FIGS. 3, 5 and 7.

The cover 14 includes a pair of opposing side walls 30 which are preferably substantially identical in construction. Each side wall 30 includes a rounded end which adjoins the rounded intersection of the top and front edges 18, 24 of one of the respective side walls 16 of the base 12. Each side wall 30 also adjoins the outer surface of one of the base side walls 16. A pair of pivot pins 32 connect the cover 14 to the base 12. The pivot pins 32 extend, respectively, through the rounded ends of the cover side walls 30 and the upper, forward portions of the base side walls 16.

A shelf 34 connects the side walls 30 of the cover 14. The shelf 34 has a width which exceeds the width of the shelf 26 of the base 12, and is preferably slightly wider than the maximum width of the base. The length of the shelf 34 is preferably less than the length of the side walls 30 to which it is connected so that the rounded end portions of the side walls 30 project beyond one of the edges 36 of the shelf. The opposite edge 38 of the shelf 34 adjoins the opposite end portions of the side walls 30. As shown in FIG. 3, the cover shelf 34 is shorter in length than the base shelf 26.

Figure 8:
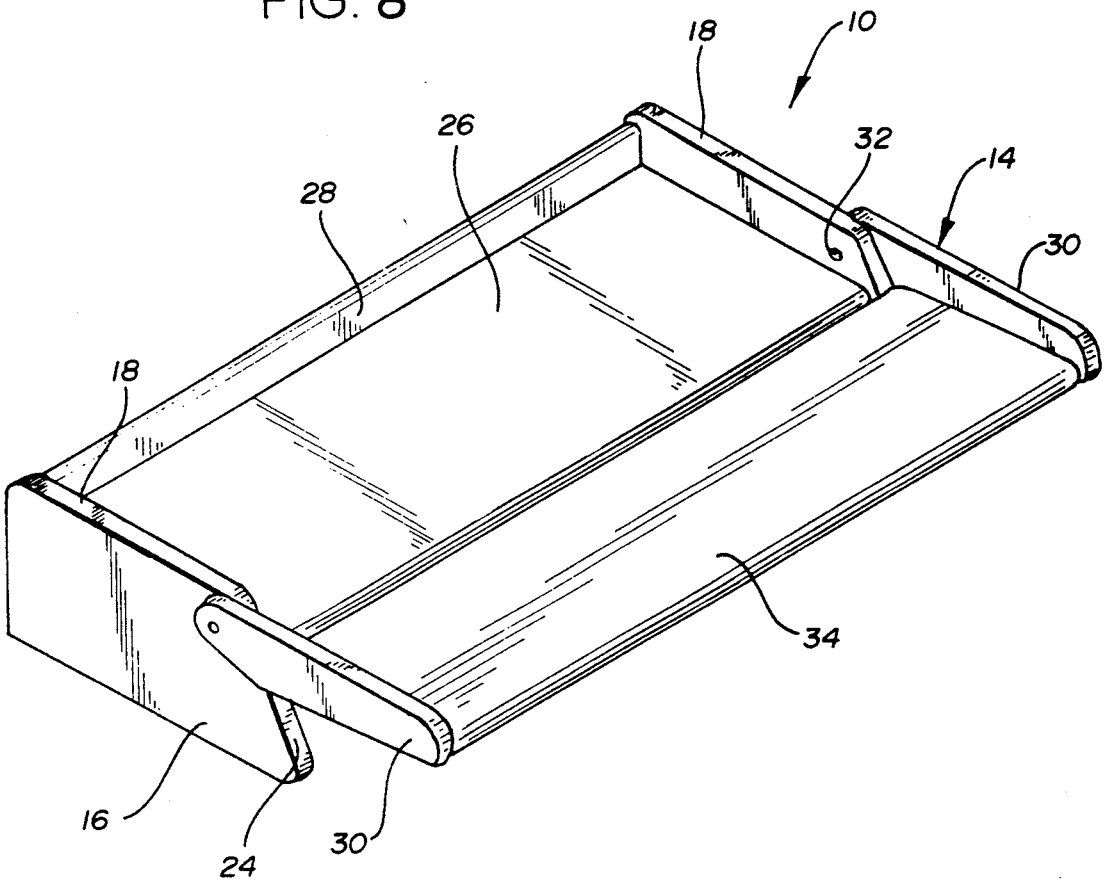
FIG. 8 is a front perspective view thereof showing the kit in an open position.
Figure 9:
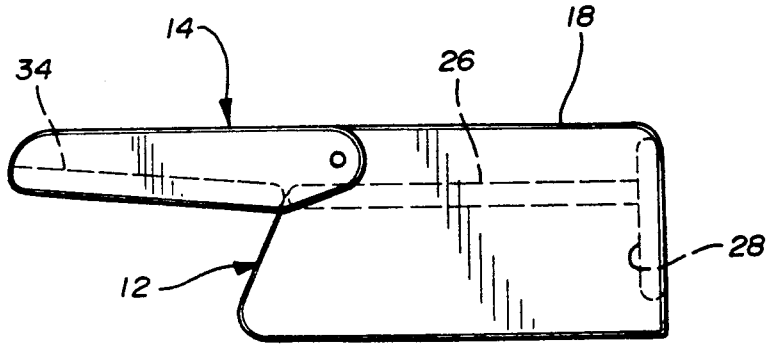
FIG. 9 is a side elevation view thereof.

The cover 14 of the dressing kit 10 may be rotated between a first rotational position, as shown in FIGS. 8 and 9, and a second rotational position as shown in FIGS. 1-7. The first position is used for dressing an infant.

When in the first position, the shelf 30 which forms part of the cover 14 abuts the inclined edges 24 of the side walls 16 of the base. This maintains the cover shelf 30 at about a five degree upward angle with respect to the base shelf 26. An infant placed upon the base shelf 26 will accordingly tend to remain there. If desired, a lip could be incorporated within the end of the cover shelf 30 farthest from the pivot pin 32. The lip would extend upwardly when the shelf 30 is in the first rotational position.

The cover shelf 30 adjoins the front edge of the base shelf 26 when the cover is rotated to the position shown in FIGS. 8–9. A smooth transition is made between the upper surfaces of the respective shelves. In addition, the upper edges of the cover side walls 30 are substantially coplanar with the top edges 18 of the base side walls 16.

The cover shelf 30 is supported by the top edges 18 of the base side walls 30 when the cover 14 is moved to the second rotational position. The front edge of the base shelf 26 protrudes beyond the leading edge 36 of the cover shelf when the cover is in this position. In addition, the shelves 26, 30 are substantially parallel to each other.

It will be appreciated that the invention may be modified in a number of ways. Though not preferred, the front edges 24 of the base may be substantially perpendicular to the top and bottom edges 18, 20 thereof. The base shelf 26 may be positioned at virtually any point with respect to the side walls 16 of the base 12 so long as the cover shelf 34 adjoins it in the first rotational position. Though preferably constructed from wood, the dressing kit 10 may alternatively be made from metal or polymeric materials.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A dressing kit comprising:

a base, said base including a pair of opposing side walls, each of said side walls including a front edge and a top edge, and a shelf connecting said side walls, said shelf including a substantially flat upper surface for at least partially supporting an infant, the side walls of said base extending above the upper surface of the shelf and the shelf having a front edge aligned with the front edges of the sidewalls, a cover pivotably mounted to said base, said cover including a pair of opposing side walls and a shelf connecting said side walls of said cover, the shelf of said cover being wider than the shelf of said base such that an edge portion of said shelf of said cover engages the front edges of the side walls of said base when in a first rotational position with respect to said base, the edge portion of said shelf of said cover being substantially co-extensive with the front edge of said shelf of said base when said cover is in the first rotational position for at least partially supporting an infant, said cover being rotatable to a second rotational position wherein the shelf of said cover engages the top edges of the side walls of said base and said shelf of said cover is substantially parallel to the shelf of said base, and in said second position the side walls of said cover are positioned in adjoining, parallel and side by side relation to the side walls of said base, each of the side walls of said cover including a first end portion extending substantially beyond the edge portion of the shelf of said cover and being pivotably secured to the side walls of said base.

2. A dressing kit as described in claim 1 wherein said front edges of said side walls of said base extend at an oblique angle with respect to said shelf of said base.

3. A dressing kit as described in claim 2 wherein said side walls of said base include top and bottom edges, said shelf of said base adjoining said side walls beneath the top edges thereof and above said bottom edges thereof.

4. A dressing kit as described in claim 1 wherein said shelf of said cover is slightly inclined with respect to said shelf of said base when said cover is in said first rotational position.

5. A dressing kit comprising:

a base, said base including a pair of opposing side walls and a shelf connecting said side walls, said shelf including a front edge and an upper surface capable of supporting an infant, each of said side walls including a rearwardly inclined front edge adjoining said front edge of said shelf, each of said side walls further including a top edge and a bottom edge, said shelf being connected to said side walls above said bottom edges and below said top edges of said side walls; and a cover including a shelf extending between a pair of opposing side walls, said side walls pivotably connected to the side walls of said base by a pair of pivot pins extending through said side walls of said cover and said base, said side walls of said cover in substantially side by side relation with the respective side walls of said base when the cover is in a second rotational position, said shelf of said cover including a first edge and a second edge, said cover being movable between a first rotational position where said first edge of said shelf of said cover adjoins said front edge of said shelf of said base and a second rotational position wherein said cover is positioned substantially above said shelf of said base, said shelf of said cover being slightly inclined with respect to said shelf of said base when said cover is in said first rotational position, the side walls of said cover being substantially longer than the length of said shelf and extending substantially beyond said one edge of said shelf where said side walls are pivotally connected to the side walls of said base.

6. A dressing kit as described in claim 5 wherein said cover is wider than said base, said side walls of said cover being positioned outside said respective side walls of said base.

7. A dressing kit as described in claim 6 wherein said base includes a rear wall extending between said side walls and disposed perpendicularly with respect to said shelf.

8. A dressing kit comprising:

a base including a pair of opposing side walls, each of said side walls including a front edge and an adjoining upper edge, a shelf connecting said side walls, said shelf including opposite edges and an upper surface for supporting an infant, and a rear wall connecting said side walls, said front edges and said upper edges of said side walls including a curved upper corner where said front edges join the respective upper edges of said side walls;

a cover including a pair of opposing side walls and a shelf having opposite edges connecting the opposing side walls of said cover, said opposing side walls of said cover being at least partially in side by side relationship with the side walls of said base, each of said side walls including a pair of curved end portions, one of said end portions of each said side wall extending substantially beyond one edge of the shelf of said cover and including an inclined edge portion;

a pair of pivot members each extending through said one end portion of each of the side walls of said cover and the respective side walls of said base, thereby pivotably securing said cover to said base;

said cover being pivotable between a closed position wherein the shelf of said cover engages an upper surface of at least one wall of said base and is substantially parallel to the shelf of said base and an open position wherein the one edge of the shelf of said cover adjoins an edge of the shelf of said base.

9. A dressing kit as described in claim 8 wherein the shelf of said cover is inclined with respect to the shelf of said base when the cover is in the open position.

* * * * *